US008559858B2

(12) United States Patent
Murakami et al.

(10) Patent No.: US 8,559,858 B2
(45) Date of Patent: Oct. 15, 2013

(54) FIXING DEVICE AND IMAGE FORMING APPARATUS

(75) Inventors: Masanori Murakami, Toyohashi (JP); Hiroshi Funabiki, Uenohara (JP); Koji Yamamoto, Toyokawa (JP)

(73) Assignee: Konica Minolta Business Technologies, Inc. (JP)

( * ) Notice: Subject to any disclaimer, the term of this patent is extended or adjusted under 35 U.S.C. 154(b) by 106 days.

(21) Appl. No.: 13/225,913

(22) Filed: Sep. 6, 2011

(65) Prior Publication Data

US 2012/0063821 A1 Mar. 15, 2012

(30) Foreign Application Priority Data

Sep. 10, 2010 (JP) ..... 2010-202538

(51) Int. Cl.
*G03G 15/20* (2006.01)

(52) U.S. Cl.
USPC ..... 399/323; 399/333

(58) Field of Classification Search
USPC ..... 399/323, 328, 333
See application file for complete search history.

(56) References Cited

FOREIGN PATENT DOCUMENTS

| | | | | |
|---|---|---|---|---|
| JP | 07-139541 | A | | 5/1995 |
| JP | 08-277833 | A | | 10/1996 |
| JP | 10198211 | A | * | 7/1998 |
| JP | 2000259021 | A | * | 9/2000 |
| JP | 3654953 | B2 | | 3/2005 |
| JP | 2007192846 | A | * | 8/2007 |

* cited by examiner

*Primary Examiner* — David Gray
*Assistant Examiner* — Erika J Villaluna
(74) *Attorney, Agent, or Firm* — Cantor Colburn LLP

(57) ABSTRACT

A fixing device includes: a fixing belt which is supported by one or more rollers; and a fixing roller which is in pressed contact with at least one of the rollers across the fixing belt, wherein the fixing roller includes a core portion which is rotatably provided, an elastic portion which covers the core portion so as to form a cylindrical shape with a rotation axis of the core portion being defined as a center, and a release portion which covers a cylindrical outer peripheral surface of the elastic portion, and an end of the elastic portion in a direction along the rotation axis and an end of the release portion in the direction along the rotation axis project from an end of the core portion, in the direction along the rotation axis, at a part where the core portion and the elastic portion are in contact with each other.

6 Claims, 8 Drawing Sheets

FIXING DEVICE AND IMAGE FORMING APPARATUS

The present U.S. patent application claims a priority under the Paris Convention of Japanese patent application No. 2010-202538 filed on Sep. 10, 2010, in which all contents of this application are disclosed, and which shall be a basis of correction of an incorrect translation.

BACKGROUND

1. Field of the Invention

The present invention relates to a fixing device and an image forming apparatus.

2. Description of Related Art

An image forming apparatus of an electrophotographic system includes a fixing device. The fixing device applies heat and pressure to a pigment (toner) transferred on a sheet, thereby fixing the pigment. The fixing device includes, for example, a fixing belt supported by two rollers, and a roller (fixing roller) which is provided at the position facing, across the fixing belt, one of the rollers supporting the fixing belt. The fixing device is configured such that a sheet on which toner is transferred passes through a contact portion (nip) between the fixing belt and the fixing roller. The fixing belt or the fixing roller is heated. When the sheet passes through the contact portion between the fixing belt and the fixing roller, the toner on the sheet is heated and pressed, whereby a fixing process is performed.

Conventionally, a layer (elastic layer) made of a material (e.g., rubber) having elasticity is formed on an outer peripheral surface of each roller used in a fixing device, as described in Japanese Patent No. 3654953, and Japanese Patent Application Laid-Open Publication No. 07-139541.

It is desired that a fixing device suitably allows a sheet, to which a fixing process is performed, to be released from a fixing roller. In view of this, there has been a fixing device in which a layer (release layer) which is made of a material (e.g., resin such as tetrafluoroethylene-perfluorovinylether copolymer (PFA)) having a hardness higher than a hardness of an elastic layer is formed to cover an outer peripheral surface of the elastic layer of each roller, in order to facilitate the release of the sheet from the fixing roller.

There has also been a fixing device in which a hardness of an outer peripheral surface of a roller facing a fixing roller is set lower than a hardness of an outer peripheral surface of the fixing roller, in order to increase a nip width.

However, in the conventional fixing device, the roller (fixing roller) having a greater hardness of its outer peripheral surface might damage the roller (roller facing the fixing roller) having relatively a lower hardness of its outer peripheral surface. For example, As shown in FIG. 7, at a portion where an end of the fixing roller in a direction along a rotation axis of each roller is brought into contact with the outer peripheral surface of the facing roller, the outer peripheral surface of the facing roller might be scraped off by the end of the fixing roller (for example, a damaged portion H shown in FIG. 7).

If the width of one of the rollers is set to be larger than the width of the elastic layer of the other roller in the direction along the rotation axis of each roller in order to prevent the end of one of the rollers in the direction along the rotation axis from being brought into contact with the outer peripheral surface of the other roller, the damage on the other roller shown in FIG. 7 is not caused. However, in this case, as shown in FIG. 8 for example, at an end of the elastic layer of the other roller, which is sandwiched between a metal core of the other roller and one of the rollers, the elastic layer projects in the direction of the rotation axis, so that a stress concentration is caused at an interface edge between the elastic layer and the metal core. Accordingly, a crack might be caused in the elastic layer might due to a pressing force at the interface edge. This crack at the interface edge sometimes becomes a starter which makes the crack progress up to a vicinity of a center of the elastic layer.

SUMMARY

The present invention is accomplished in view of the above circumstance, and an object of the present invention is to prevent a damage of a roller in a fixing device.

In order to achieve the abovementioned object, according to one aspect of the present invention, there is provided a fixing device including: a fixing belt which is supported by one or more rollers; and a fixing roller which is in pressed contact with at least one of the rollers across the fixing belt, wherein the fixing roller includes a core portion which is rotatably provided, an elastic portion which covers the core portion so as to form a cylindrical shape with a rotation axis of the core portion being defined as a center, and a release portion which covers a cylindrical outer peripheral surface of the elastic portion, and an end of the elastic portion in a direction along the rotation axis and an end of the release portion in the direction along the rotation axis project from an end of the core portion, in the direction along the rotation axis, at a part where the core portion and the elastic portion are in contact with each other.

Preferably, the end of the core portion in the direction along the rotation axis is provided such that the end is tilted toward the rotation axis, and the tilted surface and the elastic portion are bonded to each other.

Preferably, an outer peripheral surface of the end of the release portion in the direction along the rotation axis projects toward an outer periphery of a cylinder.

Preferably, the end of the elastic portion in the direction along the rotation axis is provided to have a thickness which becomes smaller toward the end.

Preferably, a width of the at least one of the rollers in the direction along the rotation axis is larger than a width of the fixing roller in the direction along the rotation axis, while the width of the fixing roller in the direction along the rotation axis is larger than a width of the fixing belt in the direction along the rotation axis.

Preferably, the release portion has a seamless cylindrical shape.

BRIEF DESCRIPTION OF THE DRAWINGS

The present invention will become more fully understood from the detailed description given hereinbelow and the appended drawings, and thus are not intended as a definition of the limits of the present invention, and wherein.

DETAILED DESCRIPTION OF THE PREFERRED EMBODIMENT

Embodiments of the present invention will be described in detail below with reference to the drawings.

Figure 1:
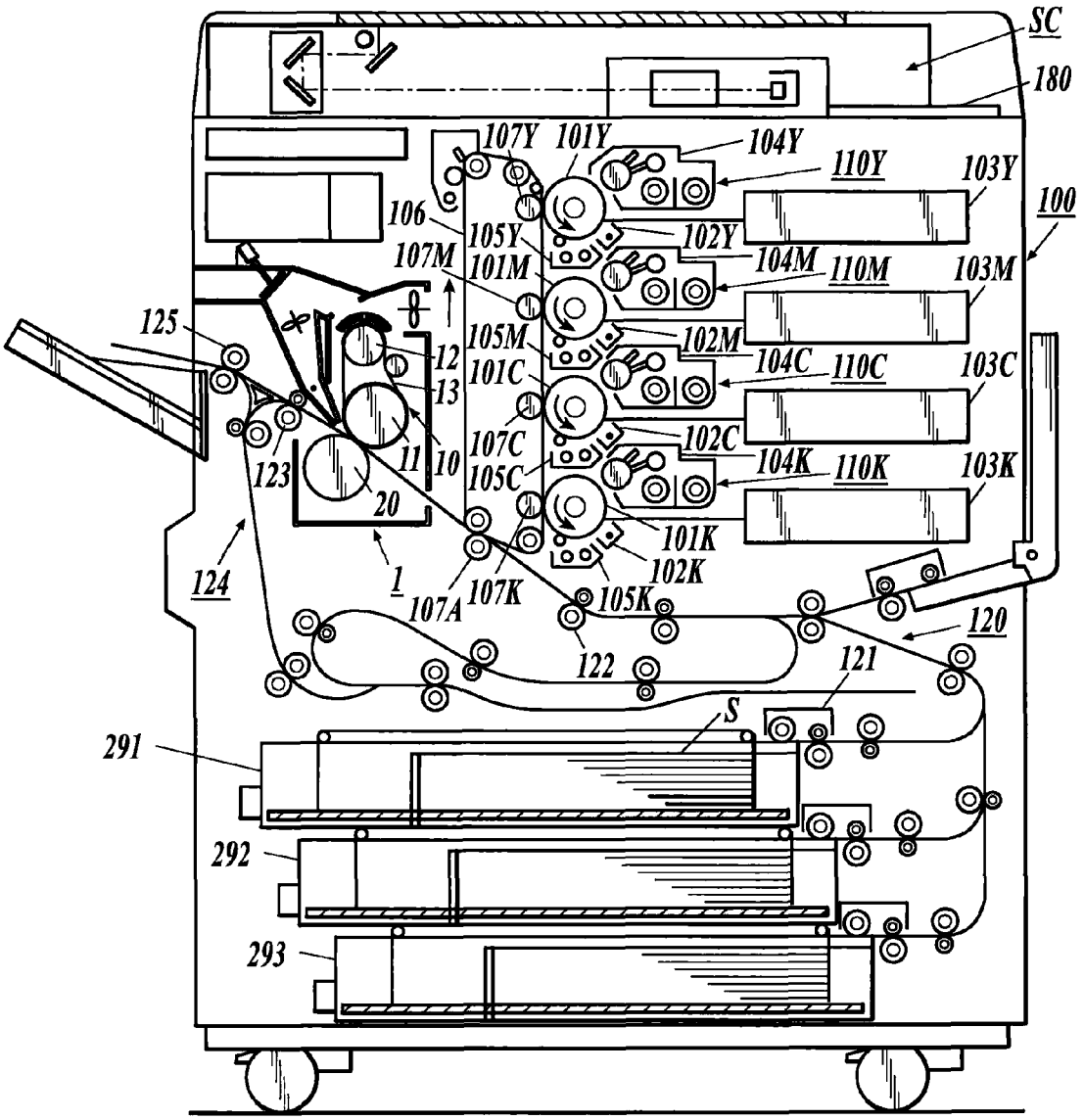
FIG. 1 is a view showing a main configuration of an image forming apparatus provided with a fixing device according to the present invention.

FIG. 1 shows a main configuration of an image forming apparatus 100 provided with a fixing device according to the present invention. The fixing device according to the present invention is used in the image forming apparatus.

The image forming apparatus 100 is referred to as a tandem-type color image forming apparatus, wherein the image forming apparatus 100 performs a color image formation with use of four image forming sections.

An image of an original document placed on a platen is scanned and exposed by an optical system in a scanning exposure apparatus of an image reading apparatus SC. The resultant image is read into a line image sensor, and photoelectrically converted into an image information signal. An analog process, an analog/digital (A/D) conversion, a shading correction, and an image compression process, and the like are performed to the image information signal at an image processing section (not shown), and then the image information signal is input into an optical writing section in the image forming section.

The four image forming sections are an image forming section 110Y which forms a yellow (Y) image, an image forming section 110M which forms a magenta (M) image, an image forming section 110C which forms a cyan (C) image, and an image forming section 110K which forms a black (K) image. The respective image forming sections are indicated by adding symbols of Y, M, C, and K, representing a color to be formed, at the end of the common numeral 110.

The image forming section 110Y includes a photosensitive drum (image carrier) 101Y, and a charging section 102Y, an optical writing section 103Y, a development device 104Y, and a drum cleaner 105Y, those of which are provided around the photosensitive drum 101Y.

Similarly, the image forming section 110M includes a charging section 102M, an optical writing section 103M, a development device 104M, and a drum cleaner 105M, those of which are provided around a photosensitive drum 101M, the image forming section 110C includes a charging section 102C, an optical writing section 103C, a development device 104C, and a drum cleaner 105C, those of which are provided around a photosensitive drum 1010, and the image forming section 110K includes a charging section 102K, an optical writing section 103K, a development device 104K, and a drum cleaner 105K, those of which are provided around a photosensitive drum 101K.

The photosensitive drums 101Y, 101M, 101C, and 101K, the charging sections 102Y, 102M, 102C, and 102K, the optical writing sections 103Y, 103M, 103C, and 103K, the development devices 104Y, 104M, 104C, and 104K, and the drum cleaners 105Y, 105M, 105C, and 105K in the respective image forming sections 110Y, 110M, 110C, and 110K have the common structures. Therefore, these components are indicated without giving the symbols Y, M, C, and K, unless otherwise specified.

The image forming section 110 writes the image information signal on the photosensitive drum 101 by the optical writing section 103, so as to form a latent image based on the image information signal on the photosensitive drum 101. The latent image is developed by the development device 104, whereby a toner image, which is a visible image, is formed on the photosensitive drum 101.

Images of yellow (Y), magenta (M), cyan (C), and black (K) are respectively formed on the photosensitive drums 101Y, 101M, 101C, and 101K in the image forming sections 110Y, 110M, 110C, and 110K.

An intermediate transfer belt 106 winds around a plurality rollers, and supported by the rollers so as to be rotatable.

The toner images of the respective colors formed by the image forming sections 110Y, 110M, 1100, and 110K are transferred, one by one, on the driving intermediate transfer belt 106 by primary transfer sections 107Y, 107M, 107C, and 107K, whereby a color image is formed by overlaying Y (yellow) layer, M (magenta) layer, C (cyan) layer and K (black) layer.

A sheet conveying section 120 conveys a sheet S. The sheet S is accommodated in sheet feed trays 291, 292, and 293. The sheet S is fed by a first feed section 121, and conveyed to a secondary transfer section 107A through a registration roller 122, whereby the color image on the intermediate transfer belt 106 is transferred on the sheet S. The fixing device 1 applies heat and pressure to the sheet S having the color image transferred thereon, whereby the toner image on the sheet S is fixed. The sheet S is then discharged to the outside of the apparatus through a fixing conveyance roller 123 and a sheet discharge roller 125.

The image forming apparatus 100 is also provided with a sheet reversing section 124. The sheet to which the fixing process has been performed is guided to the sheet reversing section 124 from the fixing conveyance roller 123 in order to discharge the sheet as being turned upside down, or in order to make an image formation on both sides of the sheet.

A size or a number of the sheet S can be set from an operation display section 180 mounted on an upper part of the main body of the image forming apparatus 100, when an image formation is to be performed.

Figure 2:
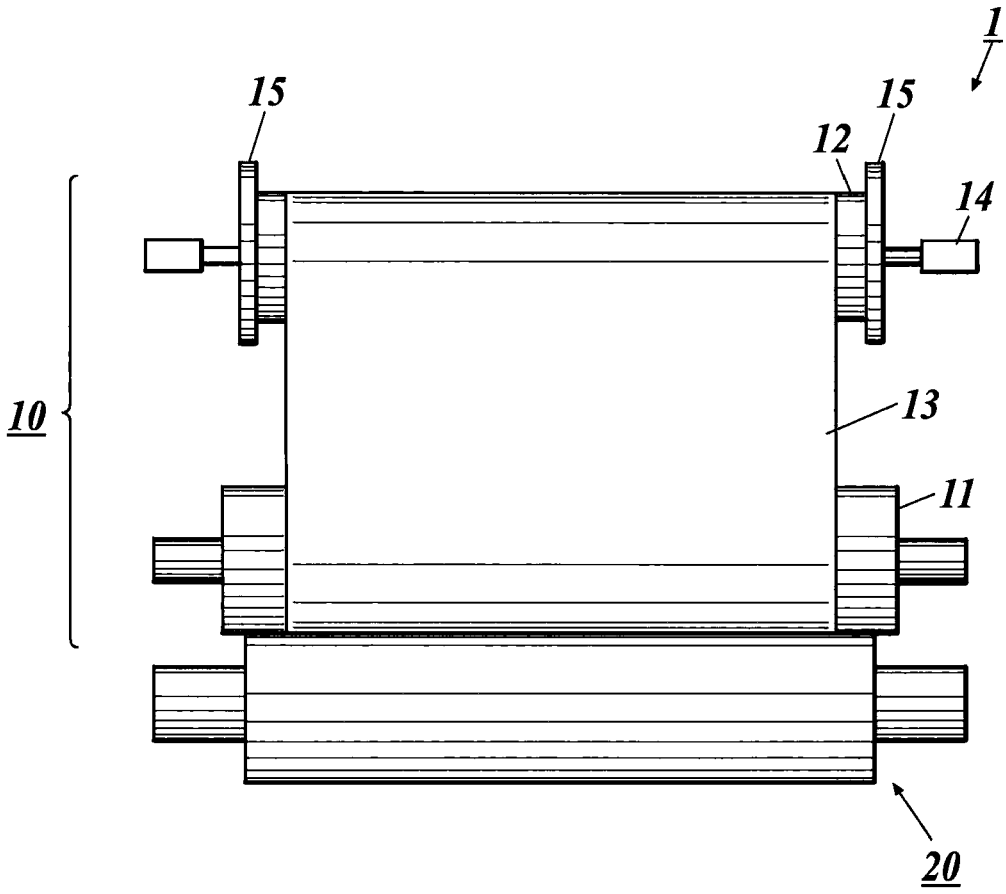
FIG. 2 is a view showing a main configuration of the fixing device according to a first embodiment of the present invention.

FIG. 2 shows a main configuration of the fixing device 1 according to a first embodiment of the present invention.

The fixing device 1 includes a belt mechanism 10, and a fixing roller 20.

The belt mechanism 10 includes two rollers 11 and 12, and a fixing belt 13 supported by the two rollers 11 and 12. The two rollers 11 and 12 are provided at an inside of the loop-type fixing belt 13 so as to support the fixing belt 13.

The two rollers and the fixing roller 20 are rotatably supported by a support section (not shown) at a position where the outer peripheral surfaces of one of the two rollers and the fixing roller 20 are brought into pressed contact with each other. The rotation axes of the respective rollers are provided to be parallel to one another. One (e.g., the roller 11 shown in FIG. 2) of the two rollers and the fixing roller 20 are provided to be in pressed contact with each other across the fixing belt 13 by the support section. The respective rollers are rotated by a drive section (not shown). A rotation direction of the fixing roller 20, and a rotation direction of the roller 11 which is provided at the position facing the fixing roller 20 and in pressed contact with the fixing roller 20, are different from each other. The sheet passes through the contact portion (nip)

between the fixing belt 13, which is operated as being supported by the roller 11 and the roller 12, and the fixing roller 20. Thus, the fixing process is performed to the sheet.

In the first embodiment, the diameter (ϕ) of the rollers 11 and 12 is 90 [mm], the diameter (ϕ) of the fixing roller 20 is 80 [mm], and the press-contact force at the nip is 2000 [N].

The width of the roller 11 in the direction along the rotation axis of each roller is larger than the width of the fixing roller 20 in the direction along the rotation axis, while the width of the fixing roller 20 in the direction along the rotation axis is larger than the width of the fixing belt 13 in the direction along the rotation axis. Both ends of the fixing belt 13 in the direction along the rotation axis is located at an inside of both ends of the fixing roller 20 in the direction along the rotation axis, while both ends of the fixing roller 20 in the direction along the rotation axis is located at an inside of both ends of the roller 11 in the direction along the rotation axis.

The roller 11 facing the fixing roller 20 is a roller whose outer periphery of a core member (e.g., a metallic core material) is covered with an elastic member (e.g., a rubber). The elastic member covering the roller 11 of the first embodiment is a rubber having a hardness of 5 [°] measured by a type A durometer specified in JIS K 6249, wherein a thickness of the rubber is 20 [mm].

The roller 12 includes a heater 14 which heats the roller 12 from the inside. The fixing belt 13 is heated by the roller 12 heated by the heater 14. The roller 12 also includes a guide section 15 for preventing the fixing belt 13 from being detached from the rollers 11 and 12.

The fixing belt 13 transmits heat to the sheet which passes through the contact portion between the fixing belt 13 and the fixing roller 20. The fixing belt 13 of the first embodiment includes a base portion which is supported as being in contact with the two rollers 11 and 12, and a rubber layer formed on an outer peripheral surface of the base portion at the side which is not in contact with the two rollers 11 and 12. The base portion is made by a polyimide (PI), and has a thickness of 80 [μm]. The thickness of the rubber layer is 200 [μm]. An outer peripheral surface, which is in contact with the fixing roller 20, of the rubber layer is covered with PFA, wherein the thickness of the PFA layer is 20 [μm].

Figure 3:
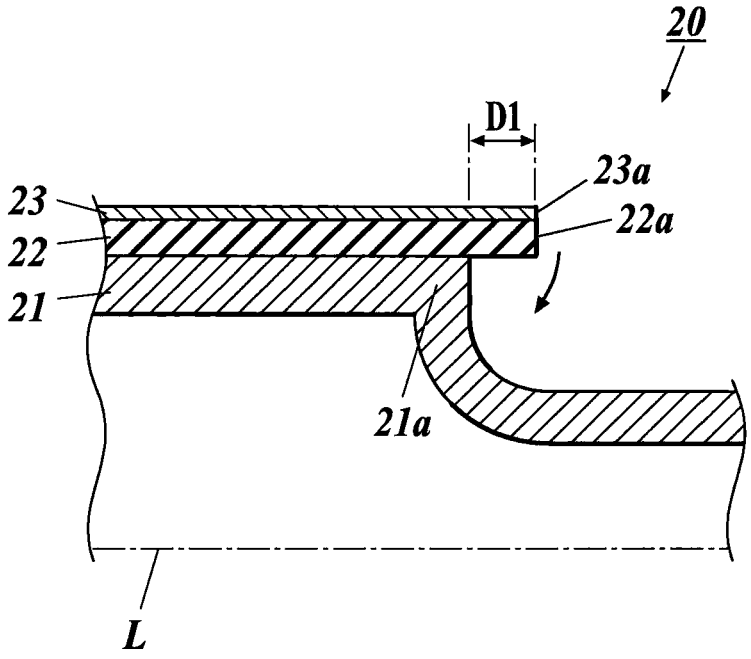
FIG. 3 is a sectional view showing a part of a fixing roller.

FIG. 3 is a sectional view showing a part of the fixing roller 20.

The fixing roller 20 includes a core portion 21, an elastic portion 22, and a release portion 23.

Both ends of the core portion 21 is rotatably supported by the above-mentioned support section, and driven to rotate by the above-mentioned drive section. The core portion 21 of the first embodiment is made of metal, but any material may be used, so long as the core portion 21 has a sufficient strength needed as core material of the elastic portion 22 and the release portion 23.

The elastic portion 22 is provided to cover an outer peripheral surface of the core portion 21 with the core portion 21 being used as core material of the roller, wherein the elastic portion 22 covers the core portion 21 in a cylindrical form having a center L of the rotation axis of the core portion 21. The elastic portion 22 of the first embodiment is a rubber having a hardness of 30 [°] measured by a type A durometer specified in JIS K 6249, wherein a thickness of the rubber is 1 [mm].

The release layer 23 covers a cylindrical outer peripheral surface of the elastic portion 22. The release layer 23 of the first embodiment is an integrally-formed seamless cylindrical tube. The release layer 23 covers the outer peripheral surface of the elastic portion 22 by providing the inner surface of the tube so as to be in intimate contact with the outer peripheral surface of the elastic portion 22. The release portion 23 of the first embodiment is made of the PFA, wherein the thickness of the layer forming the cylinder is 30 [μm].

The fixing roller 20 is provided to have a hardness which is higher than that of the roller 11 by the release portion 23 and the thickness of the elastic portion 22.

The outer peripheral surface of the core portion 21 and the inner peripheral surface of the elastic portion 22 are bonded to each other, and the outer peripheral surface of the elastic portion 22 and the inner peripheral surface of the release portion 23 are bonded to each other.

The ends of the elastic portion 22 and the release portion 23 in the direction along the rotation axis of the fixing roller 20 project from an end (e.g., an end 21*a* shown in FIG. 3) of the core portion 21, where the core portion 21 and the elastic portion 22 are in contact with each other, in the direction along the rotation axis of the fixing roller 20. FIG. 3 shows the end (end 22*a*) of the elastic portion 22 and the end (end 23*a*) of the release portion 23, which project from the end 21*a*.

The elastic portion 22 and the release portion 23 receive a pressing force when the fixing roller 20 and the roller 11 are pressed contact with each other. At that time, the core portion 21 is not present at an inside of the end 22*a* of the elastic portion 22, so that the end 22*a* and the end 23*a* are bent toward the center L of the rotation axis of the fixing roller 20 depending on the pressing force. Therefore, the stress at the press-contact portion between the fixing roller 20 and the roller 11 is reduced toward the end of the fixing roller 20. Accordingly, there is no chance that the end 23*a* of the release portion 23 scrapes the outer peripheral surface of the roller 11.

The width D1 of the end 22*a* of the elastic portion 22 and the end 23*a* of the release portion 23 projecting from the end 21*a* of the core portion 21 in the direction along the rotation axis of the fixing roller 20 can appropriately be selected according to the outer diameter size of the fixing roller 20, the thickness of the elastic portion 22, and the Young's modulus of the elastic portion 22. However, when the width D1 is too small, the effect that the end 23*a* of the release layer 23 suppresses the concentration of the stress on the outer peripheral surface of the roller 11 is reduced, resulting in that the end 23*a* of the release portion 23 might scrape the outer peripheral surface of the roller 11. On the other hand, when the width D1 is too large, and the bent end 22*a* and the end 23*a* produce a great vibration on receipt of the vibration caused by the rotation of the fixing roller 20, which might produce abnormal sound, or might cause cracks in the ends 22*a* and 23*a* and the components therearound. In the first embodiment, the width D1 is preferably within the range of 3 to 10 [mm].

According to the first embodiment, even when the elastic portion 22 and the release portion 23 receive a pressing force due to the press-contact between the fixing roller 20 and the roller 11, the end 22*a* of the release portion 22 and the end 23*a* of the release portion 23 can be bent depending on the pressing force without being hindered by the core portion 21, since the end 22*a* and the end 23*a* project from the end 21*a* of the core portion 21. Thus, the stress at the press-contact portion between the fixing roller 20 and the roller 11 is reduced toward the end 23*a*. Accordingly, there is no chance that the end 23*a* scrapes the outer peripheral surface of the roller 11. Consequently, this configuration can solve the problem, in which the outer peripheral surface of the facing roller is scraped because the outer peripheral surface of the fixing roller is in sliding contact with the outer peripheral surface of the facing roller in the conventional fixing device. Accordingly, the damage of the roller in the fixing device can preferably be prevented.

The fixing roller 20 has the hardness higher than that of the roller 11 on its outer peripheral surface. The width of the fixing roller 20 in the direction along the rotation axis of each roller is smaller than the width of the roller 11, and the both ends of the fixing roller 20 in the direction along the rotation axis are located at the position inside both ends of the roller 11 in the direction along the rotation axis. This configuration can solve the problem caused when the width of one of the rollers whose outer peripheral surface has a higher hardness is set to be larger than the width of the elastic layer of the other roller whose outer peripheral surface has a relatively lower hardness, in order to prevent the end of one of the rollers in the direction along the rotation axis from being brought into contact with the outer peripheral surface of the other roller in the conventional fixing device. Specifically, a crack caused by the pressing force at the interface edge of the elastic layer, which is due to the stress concentration at the interface edge between the elastic layer of the other roller, sandwiched between the metal core of the other roller and one of the rollers, can be prevented. Accordingly, the damage on the roller 11 in the fixing device can preferably be prevented in the first embodiment.

The width of the roller 11 and the width of the fixing roller 20 in the direction along the rotation axis of each roller are larger than the width of the fixing belt 13 in the direction along the rotation axis, and both ends of the fixing belt 13 in the direction along the rotation axis are located at the position inside both ends of the roller 11 in the direction along the rotation axis and inside both ends of the fixing roller 20 in the direction along the rotation axis. Accordingly, both ends of the fixing belt 13 in the direction along the rotation axis do not protrude from the contact portion between the roller 11 and the fixing roller 20. Specifically, the configuration can prevent that both ends of the fixing belt 13 in the direction along the rotation axis protrude from the contact portion between the roller 11 and the fixing roller 20, and are bent.

(Second Embodiment)

Next, a fixing roller 20A used in a fixing device according to a second embodiment will be described. The configurations same as that in the fixing roller 20 of the first embodiment are identified by the same numerals, and the description will not be repeated. The fixing device according to the second embodiment is the same as the fixing device 1 of the first embodiment, except that the fixing roller 20 is replaced by the fixing roller 20A.

Figure 4:
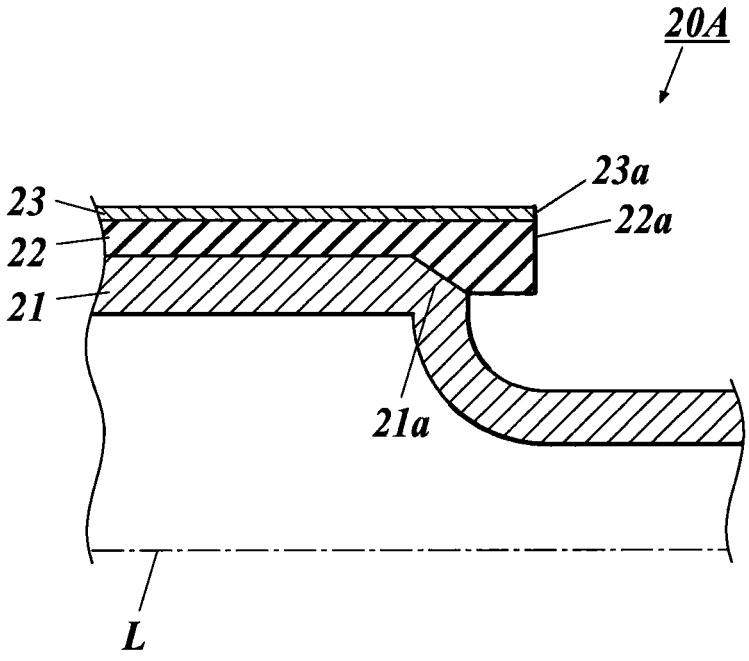
FIG. 4 is a sectional view showing a part of a fixing roller used in a fixing device according to a second embodiment of the present invention.

FIG. 4 is a sectional view showing a part of the fixing roller 20A according to the second embodiment of the present invention.

As shown in FIG. 4, the end 21*a* of the core portion 21 of the fixing roller 20A in the direction along the rotation axis is chamfered, wherein the end is formed to tilt toward the rotation axis. An inner peripheral surface of the elastic portion 22 is bonded to the tilted surface of the chamfered end 21*a*.

An outer peripheral surface of the elastic portion 22 in the second embodiment is provided to be substantially parallel to the rotation axis of the fixing roller 20, regardless of the outer peripheral surface which is in contact with the end 21*a* of the chamfered core portion 21 and the outer peripheral surface which is in contact with the core portion 21 which is not chamfered. Therefore, the elastic portion at the portion which is in contact with the end 21*a* of the chamfered core portion 21 is formed to have an increased thickness according to the tilt of the end 21*a* of the chamfered core portion 21, As shown in FIG. 4.

According to the second embodiment, the space in which the end 22*a* of the elastic portion 22 and the end 23*a* of the release portion 23 can be bent toward the core portion 21 is increased due to the tilt formed on the end 21*a* of the core portion 21. The deflection of the elastic portion 22 at the portion which is in contact with the tilt of the end 21*a* of the core portion 21 is more gentle than the degree of the deflection of the end 22*a* of the elastic portion 22 and the end 23*a* of the release portion 23 in case where there is no tilt, with the result that the deflection of the outer peripheral surface which is in contact with the tilt also becomes gentle. Accordingly, the stress concentration at the end of the nip in the direction along the rotation axis is more eased, which can more satisfactorily prevent the conventional problem, that is, the end of the fixing roller might scrape the outer peripheral surface of the facing roller.

(Third Embodiment)

Next, a fixing roller 20B used in a fixing device according to a third embodiment will be described. The configurations same as that in the fixing rollers in the first and second embodiments are identified by the same numerals, and the description will not be repeated. The fixing device according to the third embodiment is the same as the fixing device 1 of the first embodiment, except that the fixing roller 20 is replaced by the fixing roller 20B.

Figure 5:
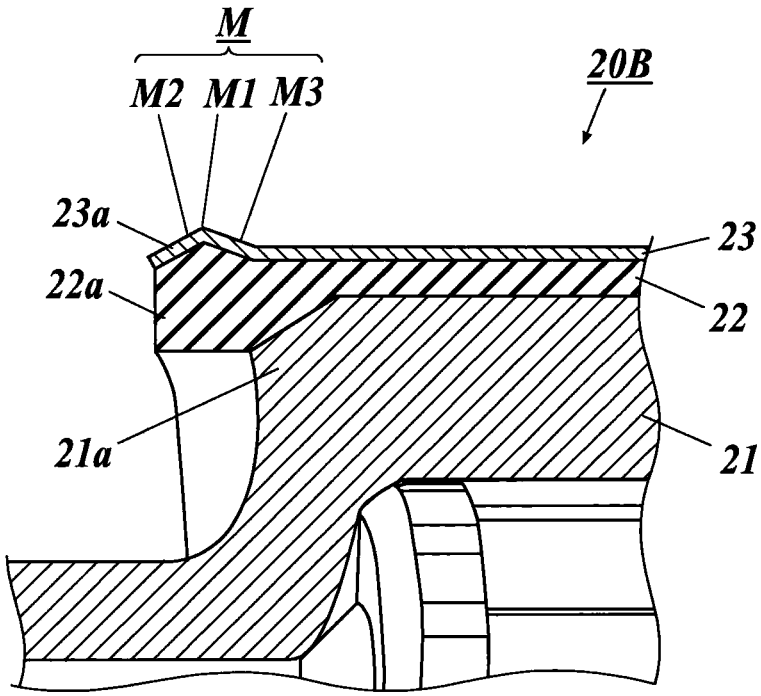
FIG. 5 is a sectional view showing a part of a fixing roller used in a fixing device according to a third embodiment of the present invention.

FIG. 5 is a sectional view showing a part of the fixing roller 20B according to the third embodiment of the present invention.

As shown in FIG. 5, the outer peripheral surface of the end 22*a* of the elastic portion 22 and the end 23*a* of the release portion 23 of the fixing roller 20B has a projecting portion M which projects toward an outer periphery of a cylinder.

The projecting portion M shown in FIG. 5 is a projecting portion having a mountain-like cross-sectional shape. Specifically, the projecting portion M has an apex M1, and a tilt M2 toward the end, and a tilt M3 at the opposite side with the apex M1 being defined as a reference. The projecting portion M is formed all around an outer peripheral surface of the fixing roller 20B.

According to the third embodiment, since the projecting portion M is brought into contact with an outer peripheral surface of the roller 11, the end 22*a* of the elastic portion 22 and the end 23*a* of the release portion 23 of the fixing roller 20B are pushed toward the rotation axis of the fixing roller 20B. Therefore, the end 22*a* and the end 23*a* are more surely bent toward the core portion 21, when receiving the pressing force through the press-contact between the fixing roller 20B and the roller 11. Accordingly, this configuration can more satisfactorily prevent the end 23*a* from scraping the outer peripheral surface of the roller 11.

The apex M1 of the fixing roller 20B shown in FIG. 5 projects outward by about a little over 1 [mm] from the outer peripheral surface, which is not the end of the fixing roller 20B. In the direction along the rotation axis of the fixing roller 20B, the width of the tilt M2 is set to be 2 [mm], and the width of the tilt M3 is set to be 3 [mm]. The numerical designs described above are only illustrative, and they can optionally be set. However, it is preferable that widths are set to a degree which can satisfactorily bend the end 22*a* of the elastic portion 22 and the end 23*a* of the release portion 23*a* toward the core portion 21, and by which the end 22*a* and the end 23*a* are not pushed toward the rotation axis of the fixing roller 20B more than necessary.

In the fixing roller 20B according to the third embodiment shown in FIG. 5, the end 21*a* of the core portion 21 in the direction along the rotation axis is chamfered, and the end is tilted toward the rotation axis, as in the fixing roller 20A in the second embodiment. An inner peripheral surface of the elastic portion 22 is brought into contact with the tilted surface of the chamfered end 21*a*.

The projecting portion M may be formed on the fixing roller which has no tilt at the end 21*a* of the core portion 21 in the direction along the rotation axis as in the fixing roller 20 of the first embodiment.

(Fourth Embodiment)

Next, a fixing roller 20C used in a fixing device according to a fourth embodiment will be described. The configurations same as that in the fixing rollers in the first to third embodiments are identified by the same numerals, and the description will not be repeated. The fixing device according to the fourth embodiment is the same as the fixing device 1 of the first embodiment, except that the fixing roller 20 is replaced by the fixing roller 20C.

Figure 6:
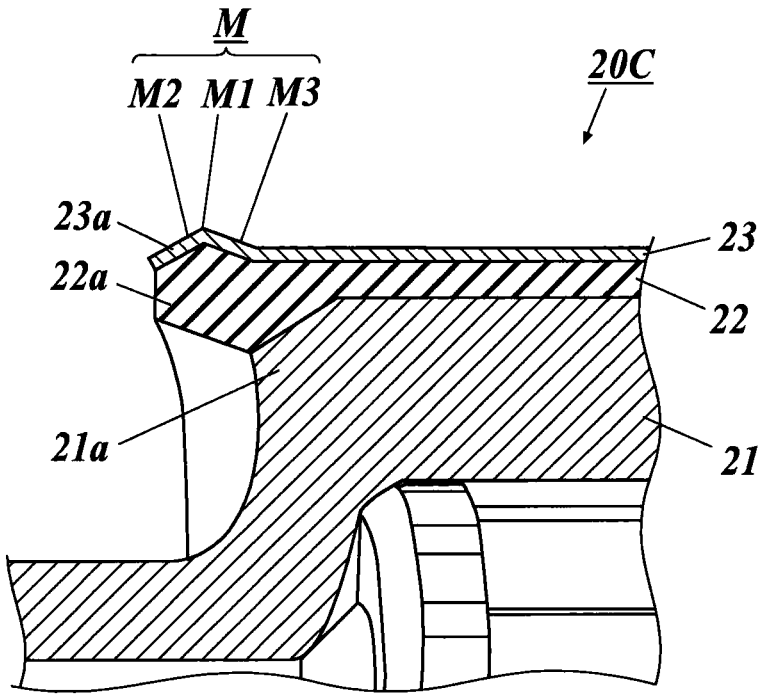
FIG. 6 is a sectional view showing a part of a fixing roller used in a fixing device according to a fourth embodiment of the present invention.
Figure 7:
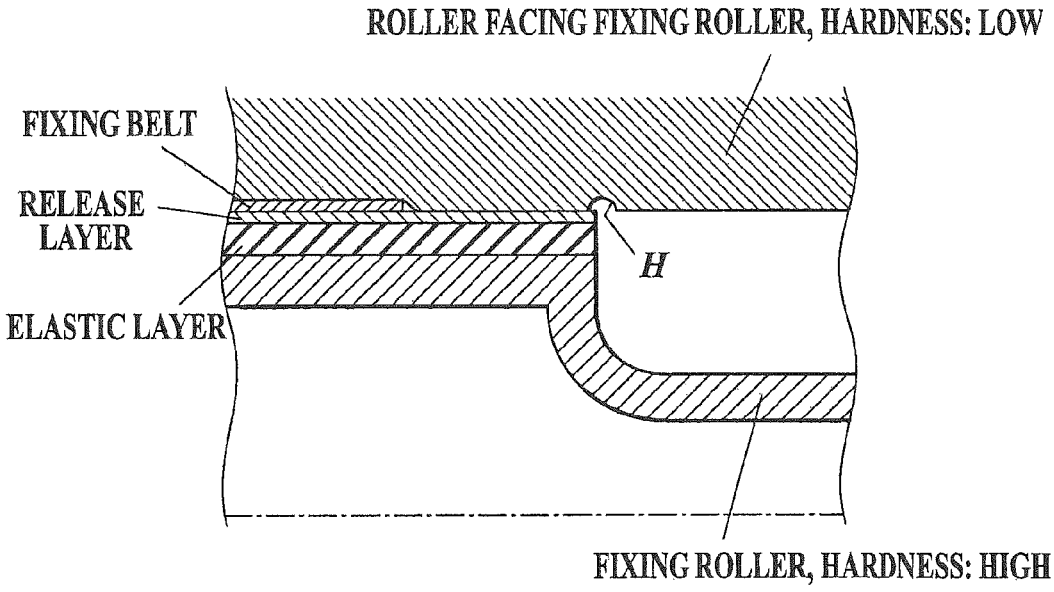
FIG. 7 PRIOR ART
FIG. 7 is an explanatory view showing an example in which a fixing roller damages a roller facing the fixing roller in a conventional fixing device.
Figure 8:
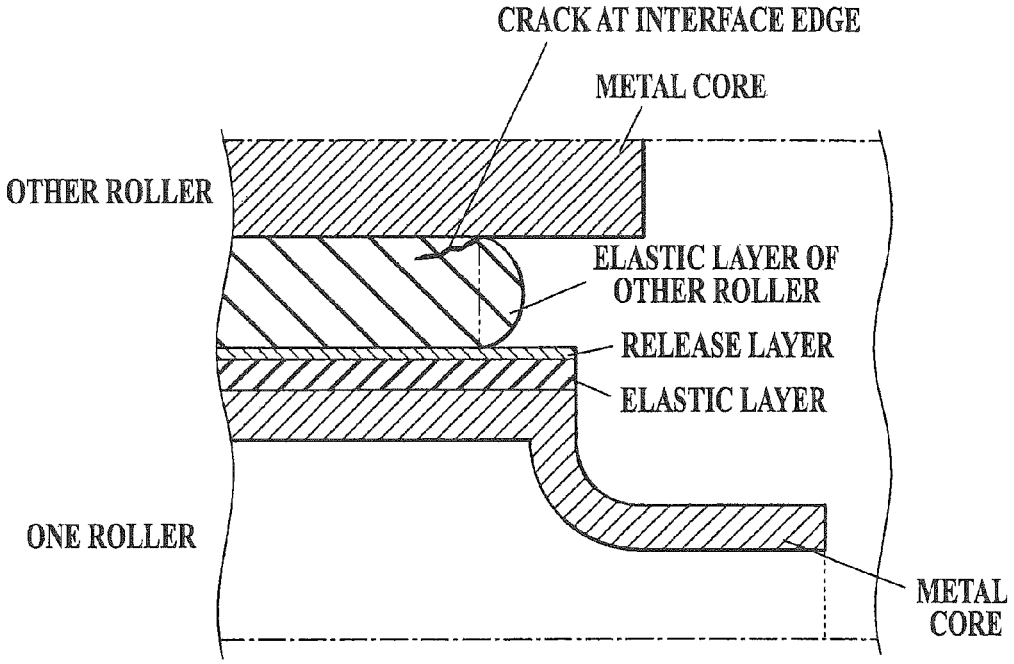
FIG.8 PRIOR ART
FIG. 8 is an explanatory view showing an example in which one of rollers damages an end of an elastic layer of the other roller in a conventional fixing device.

FIG. 6 is a sectional view showing a part of the fixing roller 20C according to the fourth embodiment of the present invention.

As shown in FIG. 6, the end 22*a* of the elastic layer 22 of the fixing roller 20C is formed to have a thickness which becomes smaller toward the end.

According to the fourth embodiment, the end 22*a* of the elastic portion 22 of the fixing roller 20C is formed to have a thickness which becomes smaller toward the end. Therefore, the end 22*a* and the end 23*a* of the release portion 23 are more easily bent. Therefore, the end 22*a* and the end 23*a* are more surely bent toward the core portion 21, when receiving the pressing force through the press-contact between the fixing roller 20C and the roller 11. Accordingly, this configuration can more satisfactorily prevent the end 23*a* from scraping the outer peripheral surface of the roller 11.

The fixing roller 20C shown in FIG. 6 according to the fourth embodiment has the projecting portion M, in which outer peripheries of the end 22*a* of the elastic portion 22 and the end 23*a* of the release portion 23 project toward an outer periphery of the cylinder, as in the fixing roller 20B according to the third embodiment. In the fixing roller 20C according to the fourth embodiment shown in FIG. 6, the end 21*a* of the core portion 21 in the direction along the rotation axis is chamfered, and the end is tilted toward the rotation axis, as in the fixing roller 20A in the second embodiment. The inner peripheral surface of the elastic portion 22 is brought into contact with the tilted surface of the chamfered end 21*a*.

The end 22*a* of the elastic portion 22 of the fixing roller 20 according to the first embodiment or the fixing roller 20A according to the second embodiment may be formed to have a thickness which becomes smaller toward the end.

The embodiments of the present invention described above should be considered in all respects as illustrative and not restrictive of the present invention. The scope of the present invention is not limited to the above description, but the accompanying claims and their equivalents are intended to cover such forms or modifications as would fall within the scope and spirit of the invention.

For example, the release portion 23 is not limited to the integrally-formed tube. For example, the release portion 23 may be formed by applying a PFA coating material on the outer peripheral surface of the elastic portion 22, and sintering the resultant. The layer of the release portion 23 made by the PFA coating material is formed to have a thickness of 15 to 20 [μm], for example.

The roller supporting the fixing belt may only be configured to include at least a single roller facing the fixing roller. For example, the fixing belt may be supported by three or more rollers, or may be supported by one or more rollers and a fixing member. A heat source for heating the fixing belt may be a roller facing the fixing roller, or may be a fixing member.

The specific design matters, such as the diameter of each roller (ϕ), the press-contact force of the nip, the material or the thickness of the layer covering each roller, can appropriately be changed.

Although the fixing roller in the above-mentioned embodiments is a roller which does not directly receive heat by a heating device such as a heater, the fixing roller according to the present invention may be heated.

According to one aspect of preferred embodiments of the present invention, the fixing device includes a fixing belt which is supported by one or more rollers, and a fixing roller which is in pressed contact with at least one of the rollers across the fixing belt, wherein the fixing roller includes a core portion which is rotatably provided, an elastic portion which covers the core portion so as to form a cylindrical shape with a rotation axis of the core portion being defined as a center of the metal core portion, and a release portion which covers a cylindrical outer peripheral surface of the elastic portion, wherein an end of the elastic portion in a direction along the rotation axis and an end of the release portion in the direction along the rotation axis project from an end of the core portion, in the direction along the rotation axis, at a part where the core portion and the elastic portion are in contact with each other.

According to the present embodiment, even if the elastic portion receives a pressing force due to the press-contact between the fixing roller and the roller facing the fixing roller, the end can be bent according to the pressing force without being hindered by the core portion, since the end of the elastic portion projects from the end of the core portion. Thus, the stress at the press-contact portion between the fixing roller and the roller is reduced toward the end, which prevents the end from scraping the outer peripheral surface of the roller. Consequently, this configuration can solve the problem, in which the outer peripheral surface of the facing roller is scraped because the outer peripheral surface of the fixing roller is in sliding contact with the outer peripheral surface of the facing roller in the conventional fixing device. Accordingly, the damage of the roller in the fixing device can preferably be prevented.

According to one aspect of the preferred embodiments of the present invention, the end of the core portion in the direction along the rotation axis is provided such that the end is tilted toward the rotation axis, wherein the tilted surface and the elastic portion are bonded to each other.

According to the present embodiment, the space where the end of the elastic portion can be bent toward the core portion is increased due to the tilt formed on the end of the core portion. The deflection of the elastic portion at the portion which is in contact with the tilt of the end of the core portion is more gentle than the degree of the deflection of the end of the elastic portion in case where there is no tilt, with the result that the deflection of the outer peripheral surface which is in contact with the tilt also becomes gentle. Accordingly, the concentration of the stress at the end of the nip in the direction along the rotation axis is more eased, which can more satisfactorily prevent the conventional problem, that is, the end of the fixing roller might scrape the outer peripheral surface of the facing roller.

According to one aspect of preferred embodiments of the present invention, an outer peripheral surface of the end of the release portion in the direction along the rotation axis projects toward an outer periphery of a cylinder.

According to the present embodiment, the end of the elastic portion of the fixing roller is pushed toward the rotation axis of the fixing roller, because the projecting portion is brought into contact with the outer peripheral surface of the roller. Therefore, the end of the elastic portion and the end of the release portion are more surely bent toward the core portion, when receiving the pressing force through the press-contact between the fixing roller and the roller. Accordingly, this configuration can more satisfactorily prevent the end from scraping the outer peripheral surface of the roller.

According to one aspect of the preferred embodiments of the present invention, the end of the elastic portion in the direction along the rotation axis is provided to have a thickness which becomes smaller toward the end.

According to the present embodiment, the end of the elastic portion of the fixing roller is provided to have a thickness which becomes smaller toward the end. Therefore, the end of the elastic portion and the end of the release portion are more easily bent. Therefore, the end of the elastic portion and the end of the release portion are more surely bent toward the core portion, when receiving the pressing force through the press-contact between the fixing roller and the roller. Accordingly, this configuration can more satisfactorily prevent the end from scraping the outer peripheral surface of the roller.

According to one aspect of preferred embodiments of the present invention, a width of the at least one of the rollers in the direction along the rotation axis is larger than a width of the fixing roller in the direction along the rotation axis, while the width of the fixing roller in the direction along the rotation axis is larger than a width of the fixing belt in the direction along the rotation axis.

According to the present invention, the crack due to the pressing force at the interface edge of the elastic layer, which is caused because the stress is concentrated on the interface edge between the elastic layer of the roller sandwiched between the metal core of the roller and the fixing roller, and the metal core, can be prevented.

Accordingly, the damage on the roller can preferably be prevented. Accordingly, both ends of the fixing belt in the direction along the rotation axis do not protrude from the contact portion between the roller and the fixing roller. Specifically, the configuration can prevent that both ends of the fixing belt in the direction along the rotation axis protrude from the contact portion between the roller and the fixing roller, and are bent.

According to one aspect of preferred embodiments of the present invention, the release portion has a seamless cylindrical shape.

According to the present embodiment, a step or the like caused by a seam on the outer peripheral surface of the fixing roller is not produced, so that the outer peripheral surface can be made smooth.

According to one aspect of preferred embodiments, an image forming apparatus includes an image forming section which forms a toner image on an image carrier; a transfer section which transfers the toner image formed on the image carrier on a recording medium; and one of the above-mentioned fixing devices which fix the toner image transferred by the transfer section.

According to the present embodiment, even if the elastic portion receives a pressing force due to the press-contact between the fixing roller and the roller facing the fixing roller, the end can be bent according to the pressing force without being hindered by the core portion, since the end of the elastic portion projects from the end of the core portion. Thus, the stress at the press-contact portion between the fixing roller and the roller is reduced toward the end, which prevents the end from scraping the outer peripheral surface of the roller. Consequently, this configuration can solve the problem, in which the outer peripheral surface of the facing roller is scraped because the outer peripheral surface of the fixing roller is in sliding contact with the outer peripheral surface of the facing roller in the conventional fixing device.

Accordingly, the damage of the roller in the fixing device can preferably be prevented.

What is claimed is:

1. A fixing device comprising:

a fixing belt which is supported by one or more rollers; and a fixing roller which is in pressed contact with at least one of the rollers across the fixing belt, wherein the fixing roller includes a core portion which is rotatably provided, an elastic portion which covers the core portion so as to form a cylindrical shape with a rotation axis of the core portion being defined as a center, and a release portion which covers a cylindrical outer peripheral surface of the elastic portion, an end of the elastic portion in a direction along the rotation axis and an end of the release portion in the direction along the rotation axis project from an end of the core portion, in the direction along the rotation axis, at a part where the core portion and the elastic portion are in contact with each other; and an outer peripheral surface of the end of the release portion in the direction along the rotation axis projects outward from the outer peripheral surface which is not the end of the fixing roller.

2. The fixing device of claim 1, wherein the end of the core portion in the direction along the rotation axis is provided such that the end is tilted toward the rotation axis, and a tilted surface and the elastic portion are bonded to each other.

3. The fixing device of claim 1, wherein the end of the elastic portion in the direction along the rotation axis is provided to have a thickness which becomes smaller toward the end.

4. The fixing device of claim 1, wherein a width of the at least one of the rollers in the direction along the rotation axis is larger than a width of the fixing roller in the direction along the rotation axis, while the width of the fixing roller in the direction along the rotation axis is larger than a width of the fixing belt in the direction along the rotation axis.

5. The fixing device of claim 1, wherein the release portion has a seamless cylindrical shape.

6. An image forming apparatus comprising:

an image forming section which forms a toner image on an image carrier;

a transfer section which transfers the toner image formed on the image carrier on a recording medium; and the fixing device according to claim 1 which fixes the toner image transferred by the transfer section.

* * * * *